US006161656A

United States Patent [19]

Horbrügger et al.

[11] Patent Number: 6,161,656

[45] Date of Patent: Dec. 19, 2000

[54] SPEED AND DIRECTION INDICATOR FOR ELEVATOR SYSTEMS

[75] Inventors: Herbert Horbrügger; Michael Mann; Helmut Schröder-Brumloop, all of Berlin, Germany

[73] Assignee: Otis Elevator Company, Farmington, Conn.

[21] Appl. No.: 09/243,360

[22] Filed: Feb. 1, 1999

[51] Int. Cl.[7] ..... B66B 3/00

[52] U.S. Cl. ..... 187/394; 187/393

[58] Field of Search ..... 187/391, 393, 187/397; 318/254, 439, 490, 54, 55

[56] References Cited

U.S. PATENT DOCUMENTS

| | | | |
|---|---|---|---|
| 2,620,898 | 12/1952 | Lund | 187/29 R |
| 3,599,755 | 8/1971 | Lund et al. | 187/29 R |
| 3,614,616 | 10/1971 | Bucek et al. | 187/29 R |
| 4,891,741 | 1/1990 | Slattery et al. | 363/35 |
| 4,987,977 | 1/1991 | Nomura | 187/112 |
| 5,157,228 | 10/1992 | Ackermann et al. | 187/112 |
| 5,334,917 | 8/1994 | Lind | 318/254 |
| 5,473,725 | 12/1995 | Chen et al. | 318/254 |
| 5,585,706 | 12/1996 | Avitan | 318/493 |

*Primary Examiner*—Jonathan Salata

[57] ABSTRACT

An elevator system includes an electronic driver which transmits a multi-phased electric current through a relay to a motor driving an elevator car. Under normal operating conditions, the motor uses the current from the driver to move the elevator car in a hoistway. When electric power fails, the elevator car is moved by gravity for any necessary rescue or maintenance operations, and consequently moves the motor. The movement of the motor generates a multi-phased electric current therein. The generated current is utilized to power a display panel of a movement indicator, which is automatically connected to the motor by the relay when power fails in the elevator system. The powered display panel informs the operator of the direction and speed of travel of the elevator car.

11 Claims, 2 Drawing Sheets

SPEED AND DIRECTION INDICATOR FOR ELEVATOR SYSTEMS

BACKGROUND OF THE INVENTION

1. Technical Field

The present invention relates to an elevator system and, more particularly, to an indicator which communicates speed and direction of travel of an elevator car during a power outage or elevator system shutdown.

2. Background Art

The conventional elevator system typically includes an elevator car traveling in a hoistway, as well as machinery and components operating and controlling the system. The elevator car has a car doorway that cooperates with hoistway doorways located on each floor of the building. The elevator car is suspended in the hoistway from a plurality of ropes driven by a motor.

The elevator car typically stops in the hoistway during a power failure or elevator system shut-down. In such event, there are usually procedures in place to rescue passengers who may be stranded in the elevator car when it stops in the hoistway. The first task for emergency workers is determining the location of the stranded elevator car in the hoistway. Depending on the elevator system, the elevator car may be found by connecting a handheld electronic display module to the control system which monitors the elevator system, or by physically observing the elevator machinery which can indicate the car location.

Once the location of the elevator car is established, emergency workers typically use gravity to raise or lower the elevator car to the nearest or safest floor. The combined weight of the elevator car and passengers determines the direction of travel: if the weight of the elevator car and passengers is more than that of the elevator counterweight, gravity will pull the elevator car downward; if it is less, gravity will move the car upward. An emergency brake is used to slowly raise or lower the elevator car. However, once the emergency brake is released, there may still be difficulties in determining the speed and direction of travel of the elevator car.

One elevator system provides a window into the hoistway to view the machinery, which has mechanical indicators to inform workers of elevator car movement. There are problems with this type of elevator system because installing the viewing window makes compliance with building codes more difficult. Additionally, the viewing window is usually located in an area that presents fire safety concerns. Also, if the elevator system has complex machinery, workers may require training to effectively correlate movement of machinery to a speed and travel direction of the elevator car.

Another solution for determining the speed and direction of travel of the elevator car is to use a back-up power supply to energize the electronics which control the elevator system under normal operating conditions. If the main power fails, the back-up power supply energizes the control system to provide movement information to the operators. In this type of system, back-up power may be useless if one of the electronic components fails and causes a system shut-down.

Therefore, there is a need for an elevator system that does not rely on a back-up power supply or problematic viewing windows to communicate the elevator car speed and direction of travel during emergency situations.

DISCLOSURE OF THE INVENTION

It is an object of the present invention to provide an elevator system which communicates the speed and direction of travel of an elevator car during a power failure or elevator system shut-down.

It is a further object of the present invention to provide a more economical and user-friendly elevator system that allows monitoring of elevator car movement during a power failure without a back-up power supply.

According to the present invention, an elevator system includes a multi-phase electric drive motor to drive an elevator car and also function as a generator when the elevator car is driven externally, such as by gravity, during a power failure. When the elevator car is so moved, the motor induces a multi-phased current which powers an indicator to communicate speed and direction of travel of the elevator car. The indicator includes a plurality of lighting filaments, each of which is connected to and is energized by a single phase winding of the motor. The indicator is usually located at a control center for convenient use by qualified personnel during rescue or maintenance operations.

The present invention has several advantages including eliminating the requirement for a back-up power supply system, which lowers the cost and simplifies the installation of the elevator system. The elevator system of the present invention is also less complex to operate during power outages because the indicator is automatically activated to communicate movement of the elevator car.

These and other objects, features and advantages of the present invention will become more apparent in the light of the following detailed description of best mode embodiments thereof as illustrated in the accompanying drawings.

BEST MODE FOR CARRYING OUT THE INVENTION

Figure 1:
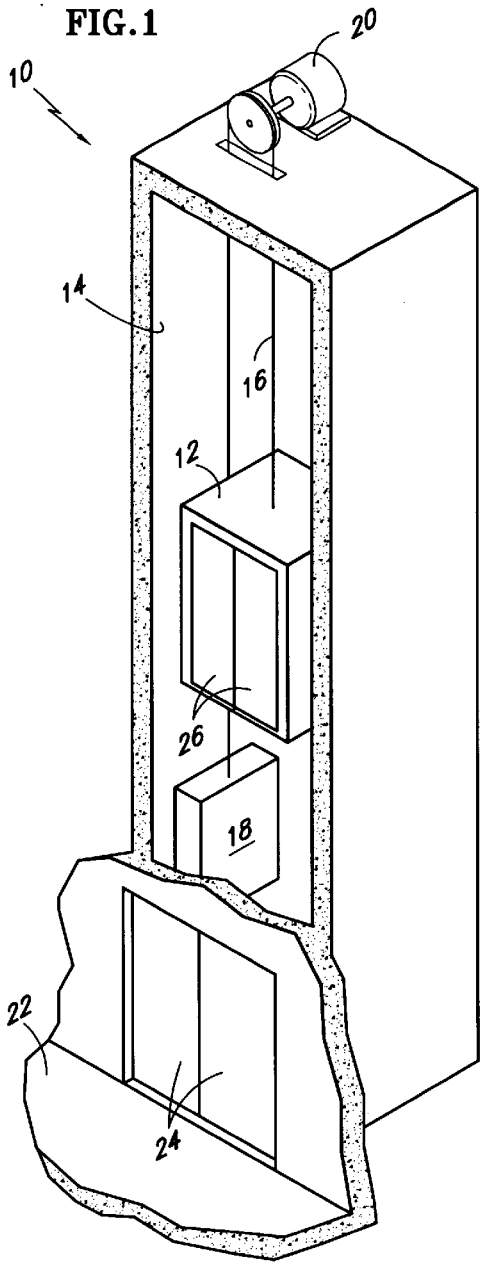
FIG. 1 is a schematic perspective view of an elevator system, with an elevator car traveling in a hoistway toward a floor landing.

Referring to FIG. 1, an elevator system 10 includes an elevator car 12 supported in a hoistway 14. The elevator car 12 is attached to one end of a rope 16, and a counterweight 18 is attached to the other end thereof. A motor 20 drives the elevator car 12 between floor landings 22. Each floor landing 22 has a hoistway doorway 24 for the ingress and egress of passengers. The elevator car 12 has a car doorway 26 that cooperates with the hoistway doorway 24 on each floor landing 22.

Figure 2:
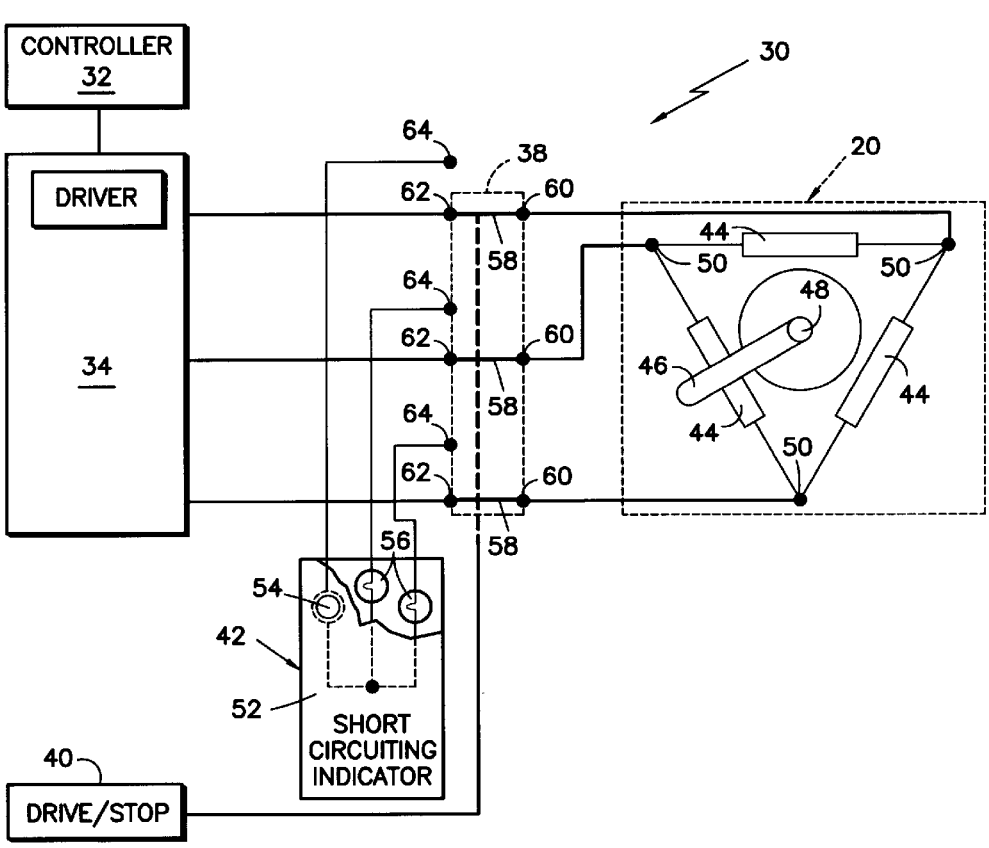
FIG. 2 is a schematic view of an elevator drive sub-assembly with a partially broken-away indicator and a relay which connects a driver with a motor driving the elevator car of the elevator system of FIG. 1.

Referring to FIG. 2, an elevator drive sub-assembly 30 includes a controller 32 providing electronic commands to a driver 34. The driver 34 supplies a multi-phase electrical current to the motor 20. A dual-position relay 38, operated by a switch 40, connects the motor 20 with either the driver 34 or an indicator 42.

The motor 20 includes three phase windings 44 and an armature 46 rotating about a motor axis 48. Each phase winding 44 is attached to an associated winding terminal 50.

Figure 3:
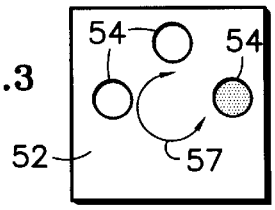
FIG. 3 is a front view of a display panel of the indicator of FIG. 2, showing directions of sequential illumination of lamp covers.

The indicator 42 includes a display panel 52 with lamp covers 54 that conceal respective lighting filaments 56. As best shown in FIG. 3, the lamp covers 54 are organized in a triangular arrangement, and a directional arrow 57 shows the possible directions of sequential illumination of the lamp covers 54.

The relay 38 has three contact arms 58 and three terminals: the motor terminals 60, the driver terminals 62, and the indicator terminals 64, as shown in FIG. 2. The contact arms 58 of the relay 38 connect the motor 20 with the movement indicator 42 or the driver 34.

Figure 5:
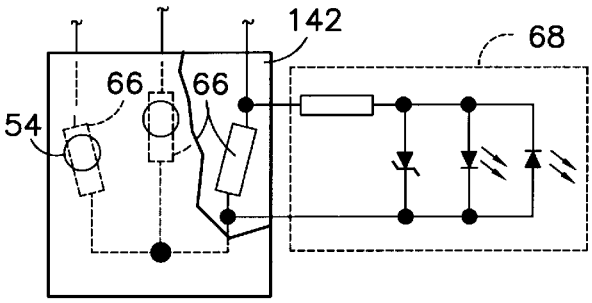
FIG. 5 is a partially broken-away, schematic view of the indicator of FIG. 4 showing attachment of one of three light emitting diodes.
Figure 4:
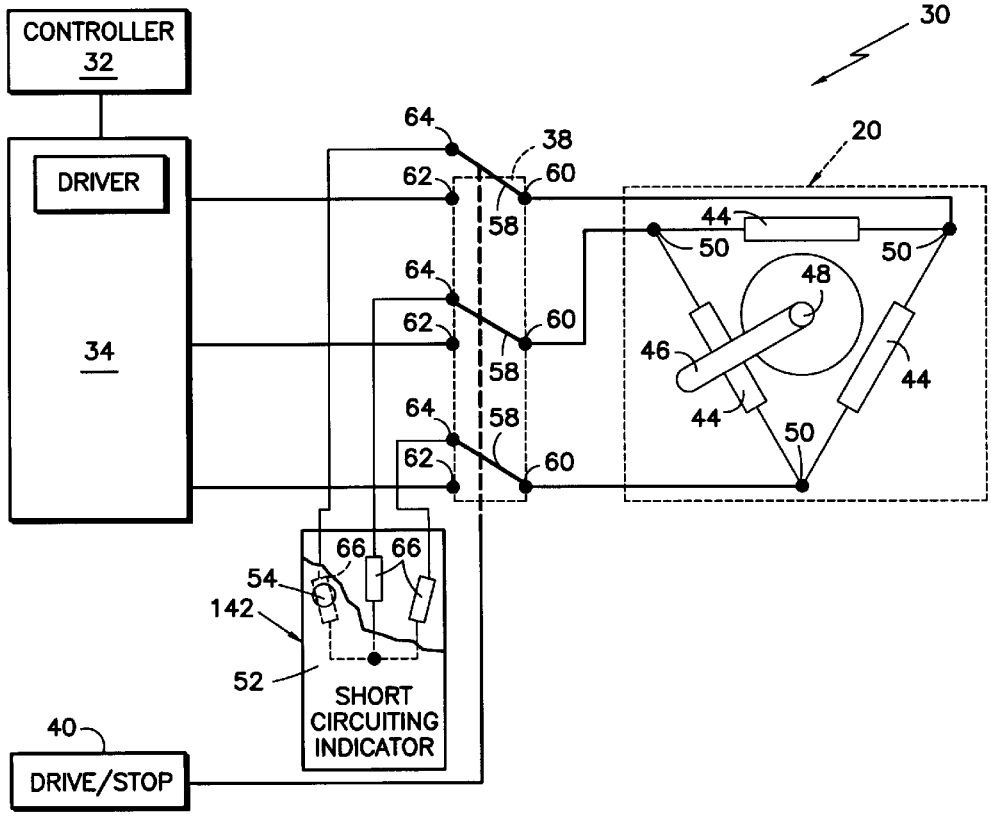
FIG. 4 is a schematic view of the elevator drive sub-assembly of FIG. 2, with an alternate embodiment of the partially broken-away indicator.

Referring to FIG. 4, an alternate embodiment of the elevator drive sub-assembly 30 includes an indicator 142, equipped with three electrical shunts 66. The display panel 52 is analogous to that of FIG. 2. One light emitting diode (LED) 68 is connected in parallel to each of the three shunts 66 of the indicator 142, as shown in FIG. 5.

Figure 6:
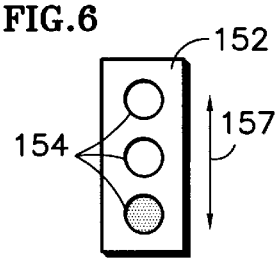
FIG. 6 is a front view of an alternate embodiment of the display panel of FIG. 3.

Referring to FIG. 6, in an alternate embodiment of the present invention, a display panel 152 includes three lamp covers 154 organized in a linear arrangement, with directional arrow 157 indicating the possible directions of sequential illumination of the covers 154.

Figure 7:
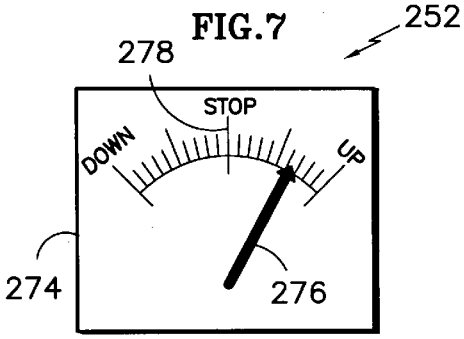
FIG. 7 is a front view of a further embodiment of the display panel of FIG. 3.

Referring to FIG. 7, in another embodiment of the present invention, the display panel 252 has an analog gauge 274 with a moveable needle 276 that indicates speed and direction of travel of the elevator car 12. The gauge 274 has a neutral, center position 278 which indicates no movement of the elevator car 12.

In operation, under normal elevator system operating conditions, the driver 34 provides the motor 20 with a three-phase electrical current via the relay 38 and the winding terminals 50, with contact arms 58 making connection between the motor terminals 60 and the driver terminals 62, as shown in FIG. 2. As electric current passes through the phase windings 44, a magnetic force is created that acts on the armature 46. The armature 46 reacts by rotating about the motor axis 48, which drives the elevator car 12 in the hoistway 14. The driver 34 controls delivery of the current to the motor 20, thereby controlling the speed and direction of rotation of the motor 20 and, thus, movement of the elevator car 12.

If electrical power or an electrical component fails and shuts the elevator system down, the controller 32 signals the contact arms 58 of the relay 38 to move from the driver terminals 62 to the indicator terminals 64, automatically disconnecting the motor from the driver 34 and connecting it to the indicator 42, as shown in FIG. 2. When the armature 46 is driven externally, such as when gravity moves the elevator car 12 in either direction, rotation of the armature 46 induces an electrical current in the phase windings 44. Because the armature 46 is equipped with three phase windings 44, a three-phased output current is produced which flows through the winding terminals 50, the relay 38, and the indicator terminals 64, to the indicator 42. The three phases of the current are wired separately to the movement indicator to energize specific filaments 56 of the indicator 42.

The lamp covers 54 of the display panel 52 are arranged so that as current is generated sequentially in the motor 20 by rotation of the armature 46, the lamp covers 54 are illuminated sequentially with a speed and in a direction that indicates the rotational speed and direction of the armature 46. If the armature 46 is rotating clockwise, the lamp covers 54 are sequentially illuminated in a clockwise direction, and vise-versa. The speed of rotation of the armature 46 is directly related to the traveling speed of the elevator car 12. Therefore, the elevator car speed also correlates to the speed of sequential illuminations of the lamp covers 54. To determine the direction and speed of the elevator car 12, the operator observes the display panel 52 and, in particular, the speed and direction of sequential illuminations of the lamp covers 54. As shown in FIG. 6, an upwardly moving sequence of illuminations corresponds with an upward speed and direction of the elevator car, and vise-versa.

The voltage of the induced current is substantially proportional to the rotational speed of the armature 46, and to the speed of the elevator car. A high rotational speed of the armature 46 generates a high voltage, while lower speeds generate lower voltages. The change in voltage is accounted for in the circuitry of the indicator 42, which allows changes in the brightness of the filaments 56 when the voltage changes. Thus, in addition to the changing speed of sequential illuminations, the brightness of each filament 56 or LED 68 varies proportionally with the rotational speed of the motor 20, thereby providing a second means of determining elevator car speed.

In situations such as power outages, emergency or maintenance personnel may need to rescue passengers from stranded elevator cars. There are usually procedures whereby gravity is used to move the elevator car 12 to the nearest or safest floor landing 22. When power fails or the elevator system shuts down, the relay 38 automatically connects the indicator 42 and disconnects the driver 34, as shown in FIG. 2. To determine speed and direction of travel of the elevator car, personnel need only observe the display panel 52, whose filaments 56 or LED 68 are sequentially illuminated in a direction and with a brightness and speed that correspond to the travel direction and speed of the elevator car.

Alternatively, the indicator 42 can be configured with an analog gauge 274, as seen in FIG. 7. Needle 276 moves from the center 278 to the left to indicate downward travel of the elevator car 12, or to the right to indicate upward travel of the elevator car 12. Increased speed in any direction is indicated by increased deflection of the needle 276 from the center 278.

One advantage of the present invention is that it obviates the need for back-up power supplies to monitor the direction of travel and speed of the elevator car 12 during power outages or elevator system shut-downs. Electrical current generated by the motor 20 of the elevator system 10 energizes the indicator 42 that communicates elevator car movement.

Another advantage of the present invention is that rescue or maintenance personnel are no longer required to connect a handheld tool or physically observe the elevator machinery in order to monitor movement of the elevator car.

In the preferred embodiment of the present invention, the motor is a permanent magnet synchronous type with three stationary phase windings. While preferred embodiments have been shown and described above, various modifications and substitutions may be made without departing from the spirit and scope of the invention. For example, an electric motor or an eddy-current meter can be energized by the induced current to operate an alternate embodiment of the indicator, and alternative types of illuminating devices are well contemplated within the scope of the present invention. Accordingly, it is to be understood that the present invention has been described by way of example and not by way of limitation.

We claim:

1. An elevator system having an elevator car driven in a hoistway, said elevator system comprising:

a motor for generating a multi-phase electric current;

an indicator utilizing said multi-phase electric current for communicating speed and direction of travel of said elevator car; and a relay having contacts movable between a first position connecting said motor to a driver, and a second position connecting said motor to said indicator.

2. The elevator system of claim 1, wherein said motor drives said elevator car in said hoistway during normal operations and generates said multi-phase electric current during special operations.

3. The elevator system of claim 1, wherein said motor includes a plurality of phase windings for generating said multi-phase electrical current.

4. The elevator system of claim 3, wherein said indicator includes a plurality of lighting filaments, each filament being electrically connected to and corresponding to one of said phase windings.

5. The elevator system of claim 4, wherein said plurality of filaments is substantially equal to said plurality of phase windings of said motor.

6. The elevator system of claim 3, wherein said indicator includes a plurality of light emitting diodes, each of said plurality of diodes being electrically connected to one of said plurality of phase windings.

7. The elevator system of claim 1, wherein said indicator has an electromechanical gauge for displaying speed and direction of travel of said elevator car.

8. The elevator system of claim 1, wherein said indicator has an array of lenses arranged in a linear pattern for displaying speed and direction of said elevator car.

9. The elevator system of claim 1, wherein said indicator has an array of lenses arranged in a circular pattern for displaying speed and direction of said elevator car.

10. The elevator system of claim 1, wherein said indicator comprises display means having brightness which changes in response to changes in said multi-phase current induced by said motor.

11. An elevator system having an elevator car moving within a hoistway, said elevator system comprising:

A motor having a plurality of phase windings that generate a multi-phase electrical current during special operations, said motor driving said elevator car in said hoistway during normal operations;

An indicator for utilizing said multi-phase current generated by said motor, said indicator having a display for communicating direction and speed of transit of said elevator; and a relay having contacts movable between a first position connecting said motor to a a driver, and a second position connecting said motor to said indicator.

* * * * *